United States Patent [19]

Chang et al.

[11] Patent Number: 4,870,911

[45] Date of Patent: Oct. 3, 1989

[54] APPARATUS FOR WASTE DISPOSAL AND METHOD

[75] Inventors: Robert C. W. Chang, Wilkins; Steven C. Vorndran, Hempfield Township, Westmoreland County; Michael F. Joseph, Monroeville, all of Pa.

[73] Assignee: Westinghouse Electric Corp., Pittsburgh, Pa.

[21] Appl. No.: 228,410

[22] Filed: Aug. 5, 1988

[51] Int. Cl.[4] ..... A47J 36/00; F23B 1/32

[52] U.S. Cl. ..... 110/246; 110/255; 432/107; 432/112

[58] Field of Search ..... 110/246, 247, 255; 432/103, 105, 107, 112

[56] References Cited

U.S. PATENT DOCUMENTS

| | | | |
|---|---|---|---|
| 2,151,320 | 3/1939 | Forni | 110/246 |
| 2,217,665 | 10/1940 | Brown | 432/112 |
| 3,906,874 | 9/1975 | Jaronko et al. | 110/246 |
| 4,154,574 | 5/1979 | Keirle et al. | 432/107 |
| 4,477,984 | 10/1984 | Wenger | 432/107 |
| 4,683,664 | 8/1987 | Codenotti | 432/112 |
| 4,730,564 | 3/1988 | Abboud | 110/246 |
| 4,748,918 | 6/1988 | Chang | 110/255 |

*Primary Examiner*—Henry C. Yuen
*Attorney, Agent, or Firm*—G. H. Telfer

[57] ABSTRACT

An incinerator pyrolyzer for continuously burning waste material characterized by a rotating kiln within a furnace chamber for incinerating waste material passing through the kiln. The kiln includes means for introducing reactants for chemically changing ingredients in the waste material. The furnace also including an outlet for dumping the incinerated residue from the kiln and an outlet for any gas generated during the burning.

9 Claims, 2 Drawing Sheets

FIG. 1.
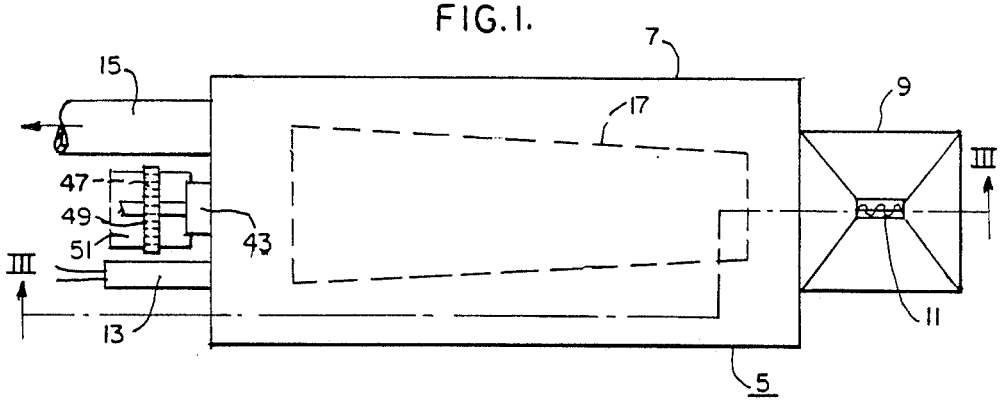
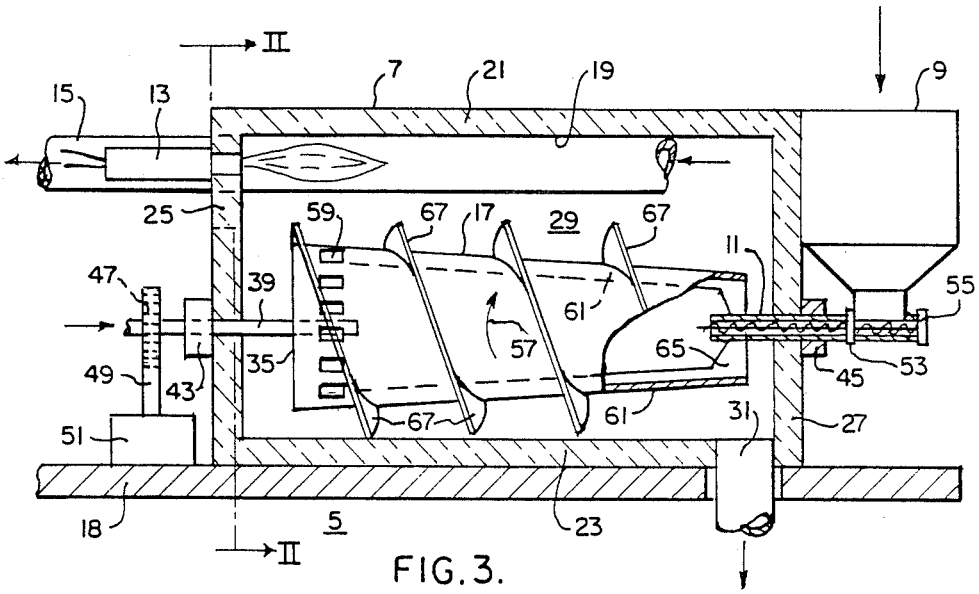
FIG. 3.

APPARATUS FOR WASTE DISPOSAL AND METHOD

BACKGROUND OF THE INVENTION

1. Field of the Invention

This invention relates to an apparatus and method for incinerating or pyrolizing waste materials and, more particularly, it pertains to the utilization of a rotatable kiln operated at elevated temperatures generated in a gas, fuel, or plasma fired furnace.

2. Description of the Prior Art

The current need for elimination of waste materials, such as residential and industrial wastes, has presented many problems. On the one hand, it is desirable to perform waste elimination as economically as possible. On the other hand, such attempts have generated other problems including the emission of harmful gases and solid particulates into the atmosphere. Various attempts have been made to incinerate material waste economically and without contamination of the atmosphere. The problem is particularly important where hazardous and toxic waste is involved, Manifestly, such materials should not be disseminated into the atmosphere.

SUMMARY OF THE INVENTION

In accordance with this invention, an incinerator for continuously burning waste materials is provided which comprises an insulating furnace enclosing an after burner chamber; a source of heat for maintaining the chamber at a temperature in excess of 1800° F.; a tubular kiln rotatably mounted within the furnace; the furnace having a bottom wall under the kiln and the bottom wall having a waste material outlet; inlet means for delivering waste materials into one end of the kiln; outlet means for dumping incinerated waste materials at the other end of the kiln and onto the bottom wall; means for introducing a reactant into the kiln; a gas outlet through the afterburner chamber; and means for moving the incinerated waste material across the bottom wall to the incinerated waste material outlet.

The invention also includes a method for continuously incinerating waste materials comprising the steps of heating a furnace at a temperature in excess of 1800° F.; rotating a kiln within the furnace; introducing waste material into one end of the kiln and discharging incinerated waste material from the other end of the kiln onto the furnace floor; and moving the discharged waste material across the furnace floor to a waste outlet therein.

An advantage of this invention is that chlorinated aromatic compounds are less likely to form if they are thermally cracked to smaller molecules such as methane, ethylene, HCl. benzene, free radicals, etc. prior to being combusted. Finally, the kiln may be operated in an oxidizing or reducing atmosphere and the formation of dioxins and furnans are avoided. Another advantage is that it has a minimal amount of air leakage and heat loss which consequently means better control and energy efficiency.

BRIEF DESCRIPTION OF THE DRAWINGS

FIG. 1 is a plan view of an incinerator in accordance with this invention;

FIG. 3 is a vertical sectional view taken on the line III—III of FIG. 1.

DESCRIPTION OF THE PREFERRED EMBODIMENT

Figure 4:
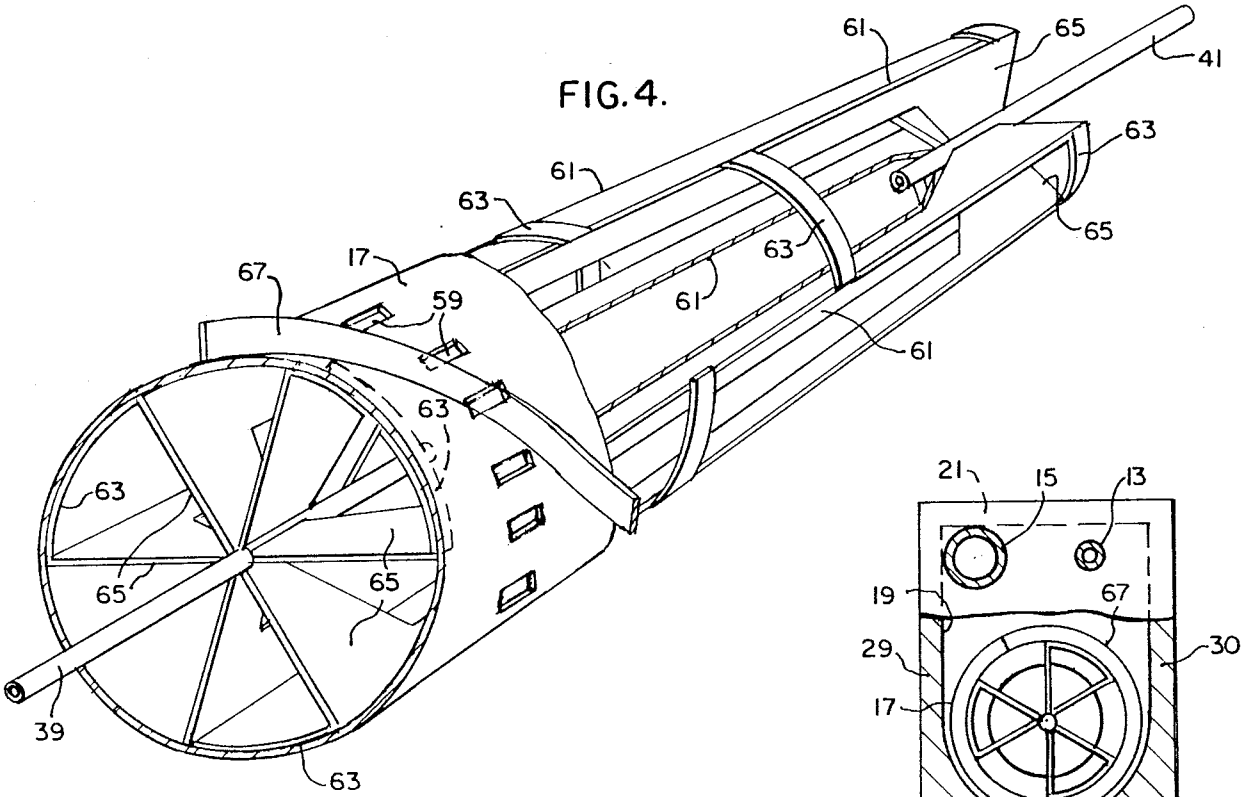
FIG. 4 is a longitudinally extending vane assembly as provided in the kiln.
Figure 2:
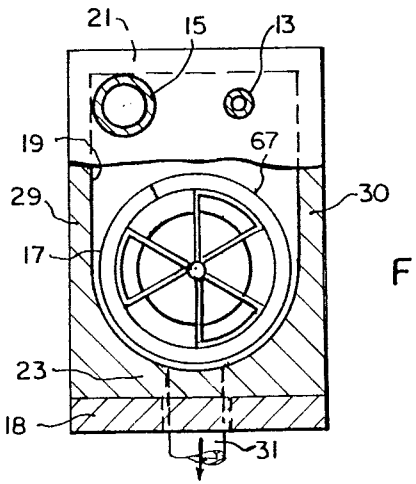
FIG. 2 is a vertical sectional view taken on the line II—II of FIG. 1.

The incinerator is generally indicated at 5 (FIG. 1) and it comprises an insulating furnace 7, a hopper or shredder 9, a screw conveyor 11 (FIG. 3), a source of heat or plasma torch 13, a gas outlet 15 and a kiln 17. The incinerator 5 is disposed on a support 18.

The furnace 7 comprises a refractory housing composed of a suitable material, and encloses an after burner chamber 19 having top and bottom walls 21, 23 opposite end walls 25, 27 and opposite side walls 29, 30. The bototm wall 23 is disposed on the support 18 and includes a residue outlet 31. The kiln 17 is disposed on a horizontal axis within the afterburn chamber 19. Opposite ends 25, 27 of the kiln are mounted on rotatable shafts 39, 41, respectively, which shafts are disposed in bearings 43, 45. The shaft 39 is hollow and is used as an auxiliary inlet for introducing air, chemicals, such as calcium oxide or hydrochloric acid, or as a sampling point. A gear wheel 47 is fixedly mounted on the shaft 39 and is connected to a drive belt 49 and motor 51.

The screw conveyor 11 extends from the lower end of the hopper 9 where a seal 53 is disposed between the conveyor and the hopper. Drive means including a gear wheel 55 is secured on a drive shaft for turning the screw conveyor 11 within the shaft 41. The kiln 17 is tapered and provides a sloped surface from the end 37 to the end 35, whereby waste material entering the conveyor from the hopper 9 through the shaft 41 moves downwardly to the left as the kiln is rotated in the direction of the arrow 57. Outlet slots 59 are disposed near the left end portion of the kiln for the exit of solid residues and gases. The kiln 17 is a tubular structure. It is composed of a material having a high coefficient of thermal conductivity, such as metal, and preferably an alloy, such as Hastelloy or equivalent. The outside of the metal can also be insulated.

As shown in FIG. 3 a plurality of vanes 61 are montned within the conical surface of the kiln 17 and are secured to the surface in order to rotate with the kiln. The vanes 61 are more particularly shown in FIG. 4 and are rigidly secured together by means of connecting support pieces 63 for maintaining the desired spacing between the vanes 61. Each vane 61 is an elongated member extending between opposite ends 35, 37 and is secured at the ends to the screw conveyor 11 and the rotatable shaft 39 by inturned spokes 65.

As shown in FIG. 3, a spiral blade 67 is mounted on the outer surface of the kiln.

Accordingly, when waste material is delivered from the hopper 9 by the screw conveyor 11 through the rotatable shaft 41, it drops onto the inner surface of the kiln and by means of the vanes 61 and the slope of the conical kiln surface. The material ultimately moves to the left end of the kiln where it drops through the outlet slots 59 onto the floor or bottom wall 23 of the furnace. During that procedure, the kiln may be operated in either an oxidizing or reducing atmosphere by the injection of reactance into the kiln through the rotatable shaft 39 as optional procedure. Chemicals, such as $CaCO_3$, may be added optionally if chlorine is present in the waste material, such as in the form of polychlorinated biphenyl or HCl, whereby the chloride radical may be eliminated as a non-deleterious compound such as $CaCl_2$. From there the spiral blade 67 moves the material to the right until it drops out of the furnace through the residue outlet 31.

Simultaneously, any gases occurring within the kiln during incineration and reaction of the waste material escape through the outlet slots 59 into the afterburner chamber 19 from where it ultimately escapes through the gas outlet 15.

The temperature within the afterburner chamber is maintained from between 1800° F. to 2200° F., while a temperature within the kiln is maintained at a range of from about 1000° F. to 1600° F. These temperatures are maintained by a source of energy, such as a propane burner.

Generally, the incinerator (or pyrolyzer) destroys organically contaminated soils, sludges, or liquids by applying the pyrolytic technology to the incineration process. A unique feature of this incinerator is that no burner is provided in the kiln. The conical shape of the metal kiln, and the interior vanes or ribs improve the mixing of the waste material internally. The spiral blade on the outer surface of the kiln further tumbles the incinerated waste material after it leaves the kiln across the bottom wall of the furnace toward the residue outlet. The waste material is introduced through a shredded/screw feeder through the hollow conveyor 11 and into the rotating conical kiln. The waste material tumbles and moves through the kiln onto the bottom wall while volatilized and pyrolized organic material escape as gases from the top of the kiln. The spiral blades outside the kiln transport the solids to the outlet from where they drop into an ash pit. Moreover, there is only a minimal air leakage through the seals, such as where the shafts pass through the furnace end walls, because the sides of the shafts are much smaller than the diameter of the kiln. Inasmuch as there are fewer gases in the kiln when operated in the pyrolitic mode, the retention time of the gases in the kiln chamber is much longer than the conventional incinerator.

In summary, the incinerator of this invention provides the advantages of compactness, heat economy, minimal economy, cold bearings, controlled air (pyrolitic oxidizing, drying, reducing), low maintenance, light weight, low solids residue time (kiln+afterburner) and long gas retention time in the kiln.

What is claimed is:

1. An incinerator or pyrolyzer for continuously processing waste materials, comprising:

an insulating furnace enclosing an afterburner chamber having a gas inlet within the furnace and a gas outlet to the exterior of the furnace;

means for heating the chamber to a temperature in excess of 1800° F.;

a tubular kiln rotatably mounted within the furnace;

the furnace having a bottom wall under the kiln and the bottom wall having a waste material outlet;

inlet means for delivering waste materials into one end of the kiln;

outlet means for dumping solid waste materials at the other end of the kiln and onto the bottom wall;

means for moving the solid waste materials across the bottom wall to the waste material outlet; and means for allowing gaseous reaction products to escape from the kiln and to enter the gas inlet to the afterburner chamber.

2. The apparatus of claim 1 in which means are provided for introducing a reactant into the kiln.

3. The apparatus of claim 2 in which the furnace is a substantially air-tight structure.

4. The apparatus of claim 3 in which the interior of the kiln includes vane means for moving the waste material from the inlet means to the outlet means.

5. The apparatus of claim 4 in which the tubular kiln comprises a narrower end adjacent to the inlet end and a wider end adjacent to the outlet end of the kiln.

6. The apparatus of claim 5 in which the vane means comprises a plurality of longitudinal axial vanes on the inner surface of the kiln.

7. An incinerator or pyrolyzer for continuously processing waste materials comprising:

an insulating furnace enclosing an after burner chamber;

means for heating the chamber to a temperature in excess of 1800° F.;

a tubular kiln rotatably mounted within the chamber, the kiln having a wall comprised of a metal;

the furnace having a bottom wall under the kiln and the bottom wall having a waste material outlet;

inlet means for delivering waste materials into one end of the kiln;

outlet means for dumping solid waste materials at the other end of the kiln and onto the bottom wall;

means for moving the solid waste material across the bottom wall to the waste material outlet;

means for introducing a reactant into the kiln;

the furnace being a substantially air-tight structure and including a gas outlet through the afterburner chamber;

the kiln including interior vane means for moving the reacted solid waste material across the bottom wall to the waste material outlet;

the kiln having a narrower end adjacent to the inlet end and a wider end adjacent to the outlet end thereof;

the interior vane means comprises a plurality of longitudinal axial vanes on the inner surface of the kiln; and the means for moving the material across the bottom wall comprises a screw type vane mounted on the external surface of the kiln.

8. A method of continuously thermally processing waste materials, comprising the steps of heating an afterburner within a furnace to a temperature in excess of 1800° C;

rotating a kiln within the furnace;

introducing waste material into one end of the kiln and discharging processed solid waste material from the other end of the kiln onto the furnace floor;

moving the discharged solid waste material across the furnace floor to a waste outlet therein; and supplying gaseous reaction products from the kiln to the afterburner.

9. The method of claim 8 wherein a reactant is introduced into the kiln.

* * * * *